US007950826B2

(12) United States Patent
Shin

(10) Patent No.: US 7,950,826 B2
(45) Date of Patent: May 31, 2011

(54) CIRCLE TYPE LED LIGHTING FLOOD LAMP USING NANO SPREADER

(75) Inventor: Sung Ho Shin, Gwangmyeong-si (KR)

(73) Assignee: Hyundai Telecommunication Co., Ltd., Seoul (KR)

( * ) Notice: Subject to any disclaimer, the term of this patent is extended or adjusted under 35 U.S.C. 154(b) by 287 days.

(21) Appl. No.: 12/371,517

(22) Filed: Feb. 13, 2009

(65) Prior Publication Data

US 2010/0102694 A1 Apr. 29, 2010

(30) Foreign Application Priority Data

Oct. 24, 2008 (KR) ..... 10-2008-0104937

(51) Int. Cl.
*F21S 4/00* (2006.01)

(52) U.S. Cl. ..... 362/249.02; 362/373; 313/11

(58) Field of Classification Search ..... 362/373, 362/294, 249.02
See application file for complete search history.

(56) References Cited

U.S. PATENT DOCUMENTS

| | | | |
|---|---|---|---|
| 3,711,702 | A | 1/1973 | Adra |
| 5,458,505 | A | 10/1995 | Prager |
| 6,446,706 | B1 | 9/2002 | Rosenfeld et al. |
| 6,698,511 | B2 | 3/2004 | DiBene, II et al. |
| 6,870,735 | B2 | 3/2005 | Genova et al. |
| 2005/0111234 | A1 | 5/2005 | Martin et al. |
| 2006/0193139 | A1 | 8/2006 | Sun et al. |

(Continued)

FOREIGN PATENT DOCUMENTS

DE 202006015980 U1 12/2006

(Continued)

OTHER PUBLICATIONS

Notice of Rejection, Korean Intellectual Property Office, dated Feb. 20, 2009, relating to Korean Patent Application No. 10-2008-0110976, 10 pages.

(Continued)

*Primary Examiner* — Nimeshkumar D Patel
*Assistant Examiner* — Donald L Raleigh
(74) *Attorney, Agent, or Firm* — Seed IP Law Group PLLC

(57) ABSTRACT

A circle type LED lighting flood lamp using a nano spreader is provided, which can provide a double heat dissipation structure formed by mounting an extended nano spreader having high heat diffusion on the inside of a circular type upper cover and making the extension parts of the nano spreader in contact with a heat dissipation portion in both directions, and prevent a heat dissipation plate from exposing to an outside by fixedly putting the upper cover on the outside of a heat dissipation member to improve the heat dissipation efficiency and the life span of the lamp. The circle type LED lighting flood lamp using a nano spreader includes LEDs, an LED mounting substrate on which the LEDs are mounted, a nano spreader having one side that is in contact with the LED mounting substrate and the other side that is extended for a specified length to form extension parts, an upper cover having inner heat dissipation pins that are in contact with the extension parts of the nano spreader, an upper cap fixed to an upper end of the upper cover, a lower heat dissipation member inserted into the inside of the upper cover and having an inner surface that is in contact with the extension parts of the nano spreader and an outer surface that is in contact with an inner surface of the upper cover, and a lower lens fixed to a lower part of the lower heat dissipation member.

9 Claims, 6 Drawing Sheets

U.S. PATENT DOCUMENTS

| | | | | |
|---|---|---|---|---|
| 2007/0230172 | A1 | 10/2007 | Wang | 362/249 |
| 2007/0230188 | A1 | 10/2007 | Lin | |
| 2007/0285926 | A1 | 12/2007 | Maxik | 362/294 |
| 2008/0024067 | A1 | 1/2008 | Ishibashi | |
| 2008/0049399 | A1 | 2/2008 | Lu et al. | |
| 2008/0186704 | A1 | 8/2008 | Chou et al. | 362/249 |
| 2008/0210407 | A1 | 9/2008 | Kim et al. | |

FOREIGN PATENT DOCUMENTS

| | | | |
|---|---|---|---|
| EP | 0902231 | A2 | 3/1999 |
| EP | 1914470 | A1 | 4/2008 |
| EP | 2025922 | A2 | 2/2009 |
| KR | 200181797 | Y1 | 6/2000 |
| KR | 20-0336197 | Y1 | 12/2003 |
| KR | 200337344 | Y1 | 12/2003 |
| KR | 1020040018107 | A | 3/2004 |
| KR | 100496522 | B1 | 6/2005 |
| KR | 200404242 | Y1 | 12/2005 |
| KR | 200421191 | Y1 | 7/2006 |
| KR | 200427060 | Y1 | 9/2006 |
| KR | 100748074 | B1 | 8/2007 |
| KR | 1020080054177 | A | 6/2008 |
| KR | 1020080062086 | A | 7/2008 |
| KR | 1020080093284 | A | 10/2008 |
| WO | 02097884 | A1 | 12/2002 |
| WO | 2008093978 | A1 | 8/2008 |

OTHER PUBLICATIONS

Notice of Rejection, Korean Intellectual Property Office, dated Apr. 23, 2009, relating to Korean Patent Application No. 10-2008-0100393, 8 pages.

CIRCLE TYPE LED LIGHTING FLOOD LAMP USING NANO SPREADER

CROSS-REFERENCE TO RELATED APPLICATION

This application is based on and claims priority from Korean Patent Application No. 10-2008-104937, filed on Oct. 24, 2008 in the Korean Intellectual Property Office, the disclosure of which is incorporated herein in its entirety by reference.

BACKGROUND OF THE INVENTION

1. Field of the Invention

The present invention relates to an LED lighting flood lamp, and more particularly, to a circle type LED lighting flood lamp using a nano spreader, which can maximize heat dissipation efficiency by expanding a heat dissipation area through a double heat dissipation structure formed by mounting an extended nano spreader having high heat diffusion on the inside of a circular type upper cover and making all extension parts of the nano spreader in contact with a heat dissipation portion in both directions, and can prevent a heat dissipation plate from exposing to an outside by fixedly putting the upper cover on the outside of a heat dissipation member to improve the heat dissipation efficiency and to prolong the life span of the LED lighting flood lamp.

2. Description of the Prior Art

In general, various kinds of flood lamps including vehicle head lamps, rear combination lamps, street lamps, and the like, use a bulb as their light source.

However, since the conventional bulb has a short life span and a lowered anti-shock performance, there is a recent trend that a high-luminance LED (Light Emitting Diode) having a long life span and an excellent anti-shock performance is used as a light source.

Particularly, the high-luminance LED can be used as a light source of various kinds of flood lamps including vehicle head lamps, rear combination lamps, interior lamps, street lamps, and the like, and its application range is extensive.

The high-luminance LED emits superheat when it is turned on, and due to this superheat emission, there are difficulties in designing and applying the LED as a light source.

Particularly, in the case of a high-capacity LED lighting flood lamp for outdoors, the size of the heat dissipation plate becomes great to cause inconvenience in installation and use, and foreign substances are accumulated on the exposed heat dissipation plate to deteriorate the heat dissipation efficiency.

SUMMARY OF THE INVENTION

Accordingly, the present invention has been made to solve the above-mentioned problems occurring in the prior art while advantages achieved by the prior art are maintained intact.

One object of the present invention is to provide a circle type LED lighting flood lamp using a nano spreader, which can provide a double heat dissipation structure formed by mounting an extended nano spreader having high heat diffusion on the inside of a circular type upper cover and making the extension parts of the nano spreader in contact with a heat dissipation portion in both directions, and prevent a heat dissipation plate from exposing to an outside by fixedly putting the upper cover on the outside of a heat dissipation member to improve the heat dissipation efficiency and the life span of the lamp.

In order to accomplish this object, there is provided a circle type LED lighting flood lamp using a nano spreader, according to an embodiment of the present invention, which includes LEDs; an LED mounting substrate on which the LEDs are mounted; a nano spreader having one side that is in contact with the LED mounting substrate, and the other side that is extended for a specified length to form extension parts; an upper cover having inner heat dissipation pins that are in contact with the extension parts of the nano spreader; an upper cap fixed to an upper end of the upper cover; a lower heat dissipation member inserted into the inside of the upper cover and having an inner surface that is in contact with the extension parts of the nano spreader and an outer surface that is in contact with an inner surface of the upper cover; and a lower lens fixed to a lower part of the lower heat dissipation member.

The circle type LED lighting flood lamp according to an embodiment of the present invention may further include sealing members inserted between the upper cap and the upper cover, between the upper cover and the lower heat dissipation member, and between the lower heat dissipation member and the lower lens, respectively, to improve waterproof performance.

The nano spreader may include a lower end part that is in partial contact with the LED mounting substrate, and the extension parts branched from the lower end part and extended upward.

The upper ends of the extension parts of the nano spreader may be extended up to an upper portion of the upper cover to increase an area of the heat dissipation part.

It is preferable that grooves are formed at predetermined intervals on a lower end part of an exterior housing of the upper cover to make an inflow of outside air.

The exterior housing of the upper cover may have a recess part formed in the center of an upper part of the exterior housing, and outer heat dissipation pins may be formed along the circumference of the recess part to make effective heat dissipation through the upper cover.

The lower heat dissipation member may include a hollow cylindrical member and a plurality of heat dissipation plates installed at predetermined intervals along the circumference of the cylindrical member, wherein when the upper cover is fixedly put on the heat dissipation plates, a heat dissipation path is formed between the upper cover and the heat dissipation plates.

The size of the heat dissipation path becomes smaller to make flow of inner air passing through the heat dissipation path faster as the heat dissipation path goes from the lower part to the upper part of the upper cover.

According to the circle type LED lighting flood lamp using a nano spreader according to the present invention, the heat dissipation efficiency is improved by expanding a heat dissipation area through a double heat dissipation structure formed by mounting an extended nano spreader having high heat diffusion on the inside of a circular type upper cover and making extension parts of the nano spreader in contact with a heat dissipation portion in both directions, and a heat dissipation plate is prevented from exposing to an outside by fixedly putting the circle type upper cover on the outside of a heat dissipation member to prevent the deterioration of the heat dissipation efficiency and to improve the life span of the LED lighting flood lamp.

In addition, since it is not required to extend the size of the heat dissipation plate even in the case of a high-capacity LED lighting flood lamp, the LED lighting flood lamp can be conveniently installed and used.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a circle type LED lighting flood lamp using a nano spreader according to the preferred embodiment of the present invention will be described in detail with reference to the accompanying drawings.

Figure 1:
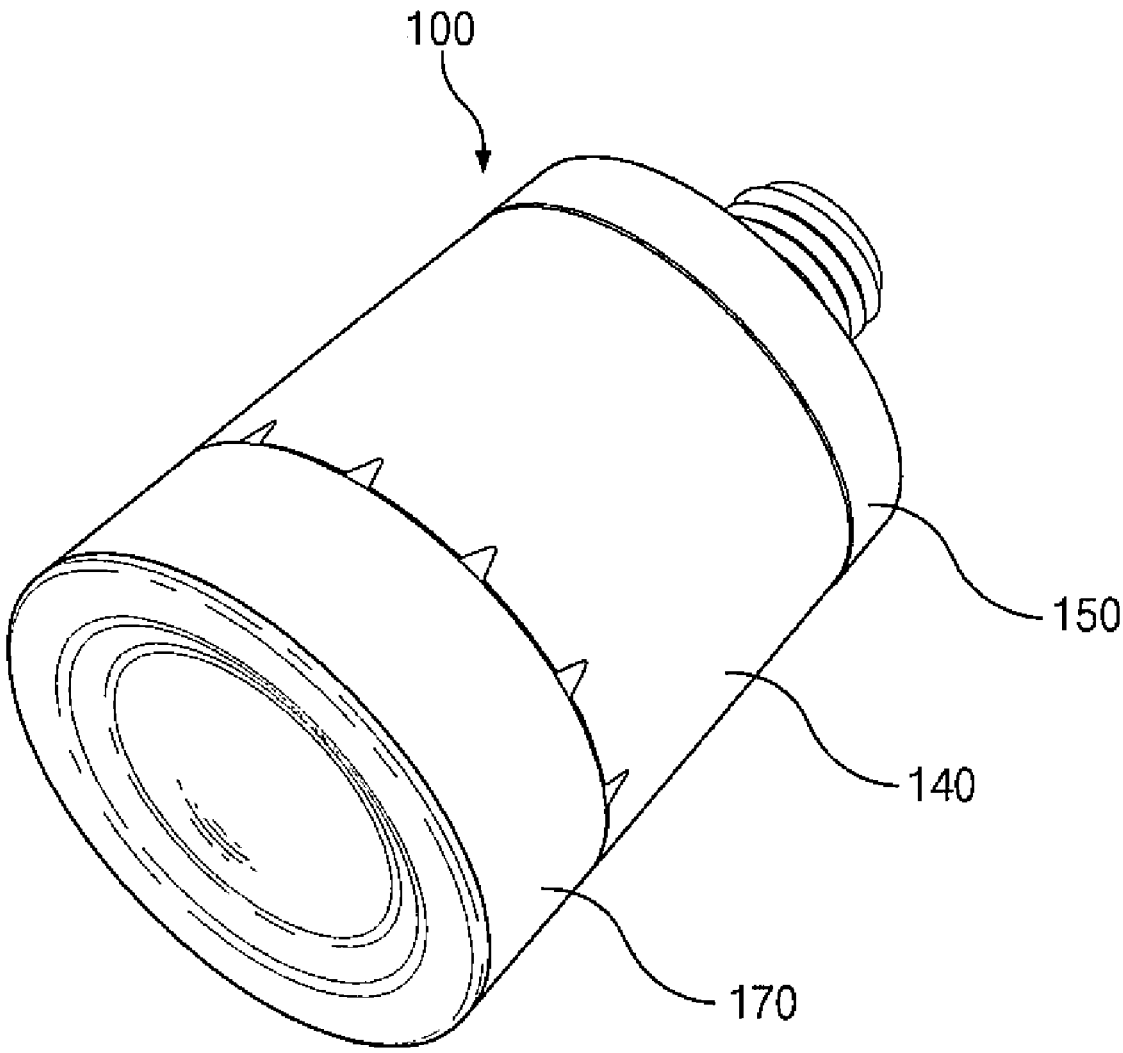
FIG. 1 is a perspective view of a circle type LED lighting flood lamp using a nano spreader according to an embodiment of the present invention.
Figure 2:
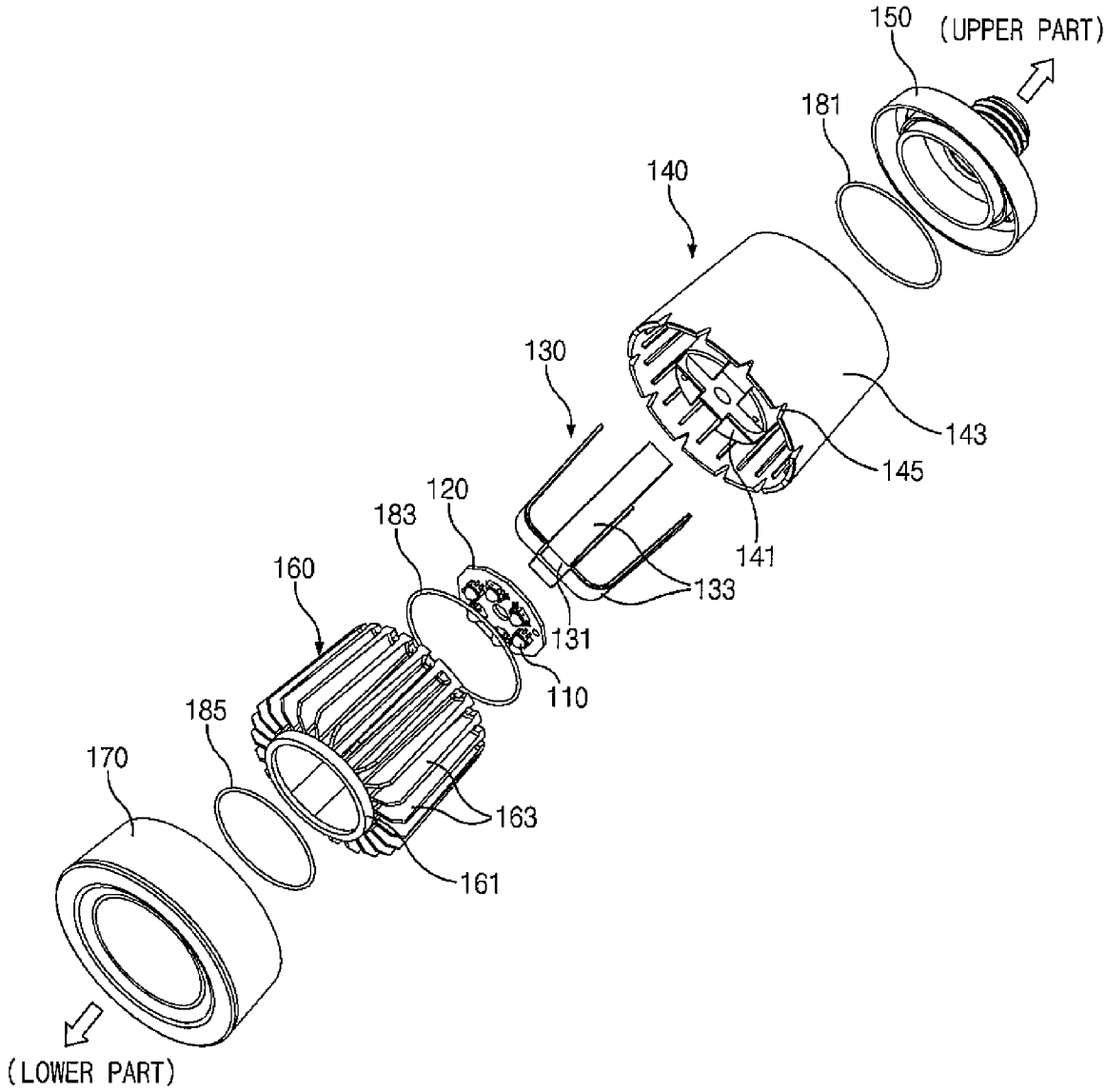
FIG. 2 is an exploded perspective view of the LED lighting flood lamp illustrated in FIG. 1.
Figure 3A:
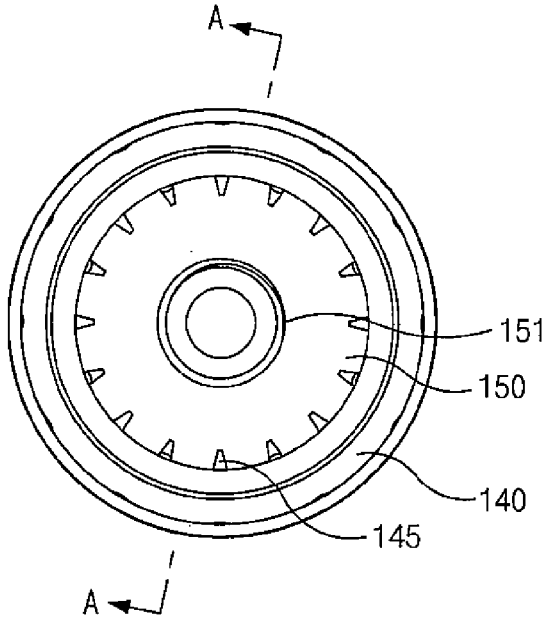
FIGS. 3A to 3C are plan, side, and sectional views of the LED lighting flood lamp illustrated in FIG. 1.
Figure 3B:
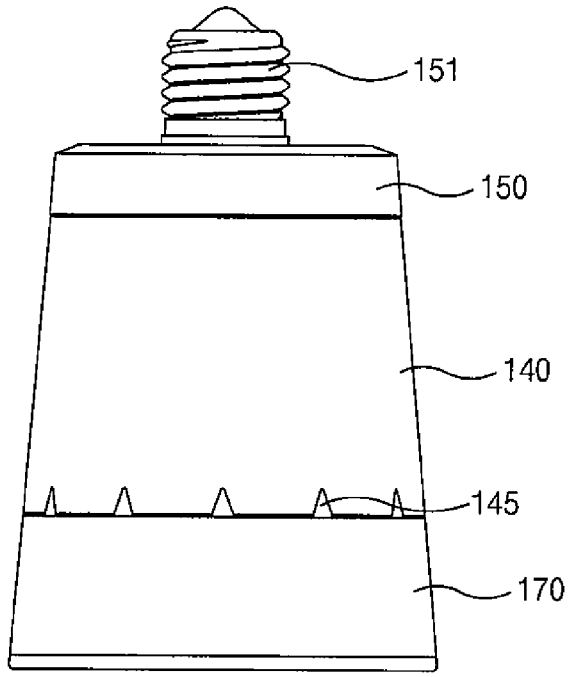
Figure 3C:
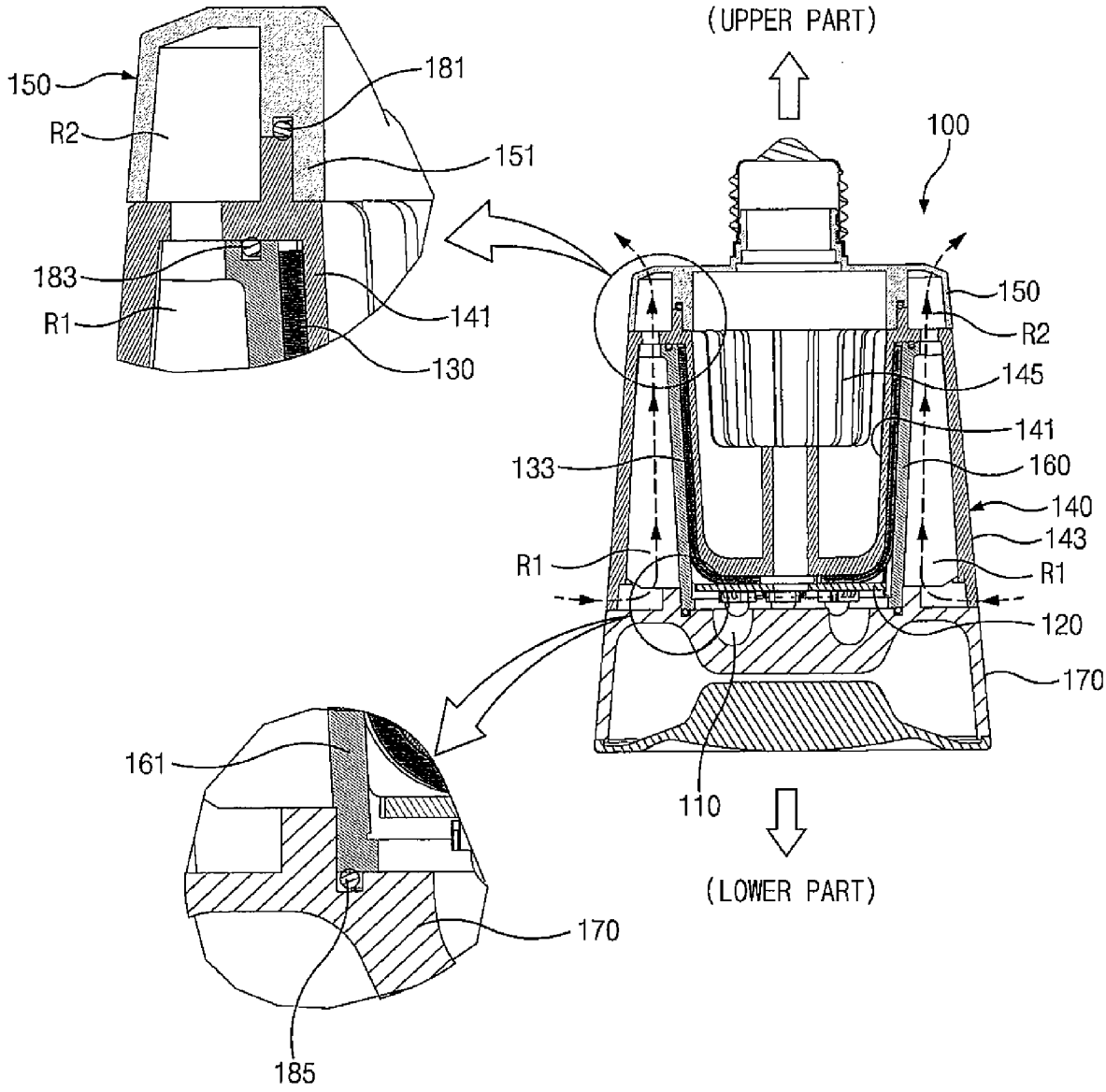
Figure 4A:
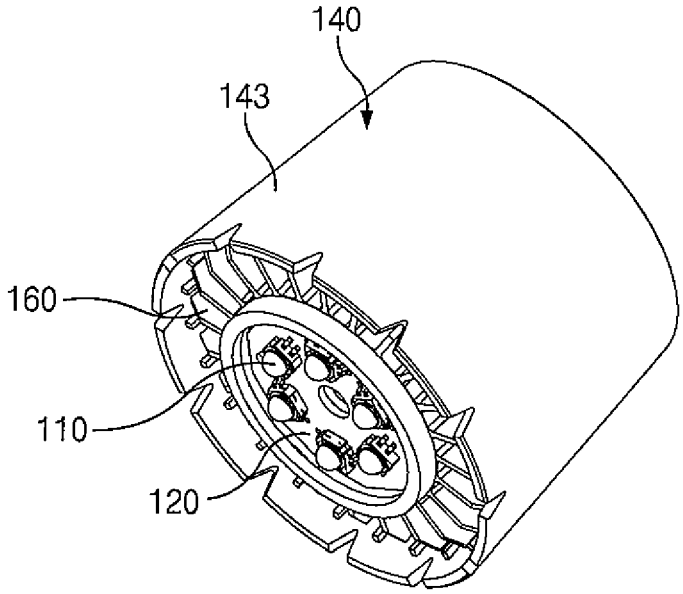
FIGS. 4A to 4C are views illustrating the assembled state of a circle type LED lighting flood lamp in which a nano spreader and a lower heat dissipation member are inserted into the inside of an upper cover according to an embodiment of the present invention.
Figure 4B:
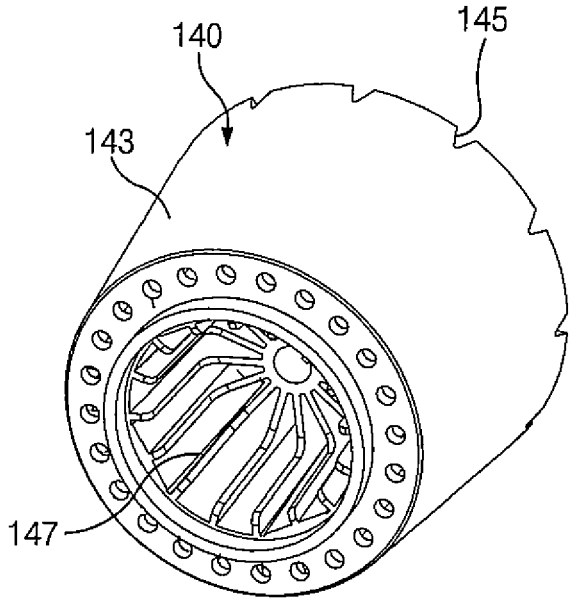
Figure 4C:
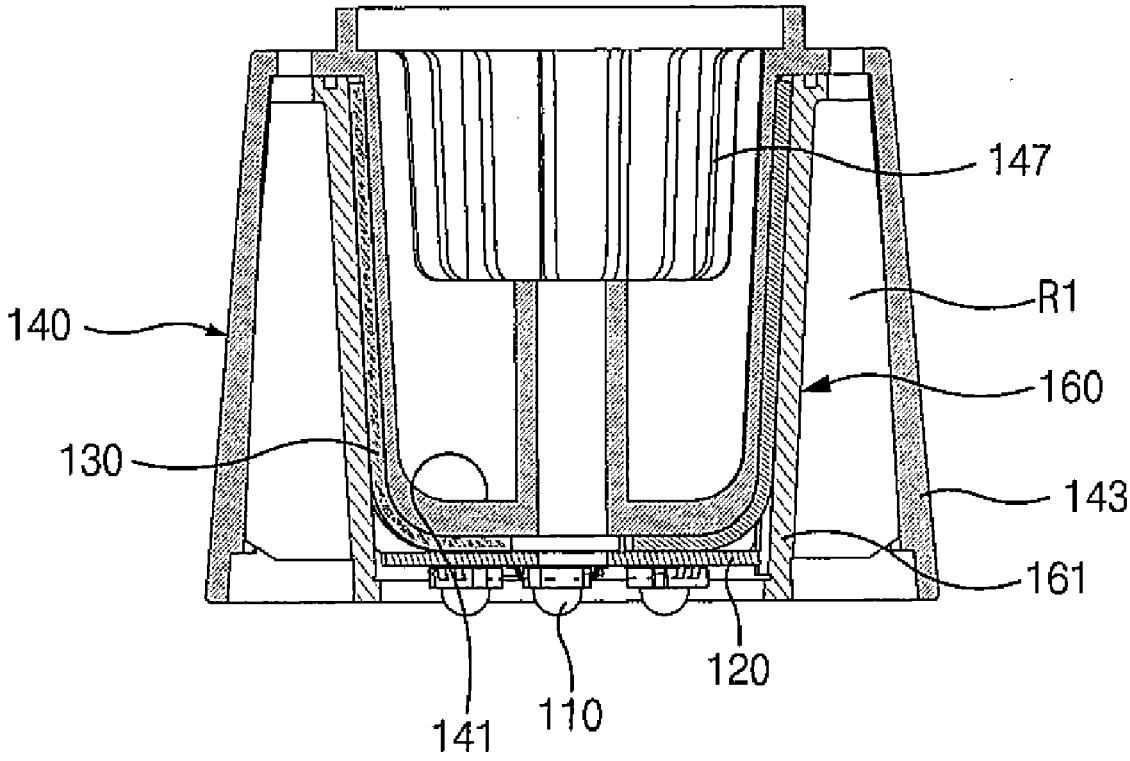

FIG. 1 is a perspective view of a circle type LED lighting flood lamp using a nano spreader according to an embodiment of the present invention, and FIG. 2 is an exploded perspective view of the LED lighting flood lamp illustrated in FIG. 1. FIGS. 3A and 3C are plan and side views of the LED lighting flood lamp illustrated in FIG. 1, and FIG. 3C is a sectional view taken along line A-A in FIG. 3A. FIGS. 4A to 4C are views illustrating the assembled state of a circle type LED lighting flood lamp in which a nano spreader and a lower heat dissipation member are inserted into the inside of an upper cover according to an embodiment of the present invention. FIGS. 4A and 4B are perspective views, and FIG. 4C is a sectional view.

With reference to the above described drawings, a circle type LED lighting flood lamp 100 using a nano spreader 130 according to an embodiment of the present invention has a structure in which an extended nano spreader 130 having high heat diffusion is mounted on the inside of a circular type upper cover 140.

The circle type LED lighting flood lamp 100 using a nano spreader 130 according to an embodiment of the present invention includes LEDs 110, an LED mounting substrate 120 on which the LEDs 110 are mounted, a nano spreader 130 having one side that is in contact with the LED mounting substrate 120 and the other side that is extended for a specified length to form extension parts 133, an upper cover 140 having inner heat dissipation pins 141 that are in contact with the extension parts 133 of the nano spreader 130, an upper cap 150 fixed to an upper end of the upper cover 140, a lower heat dissipation member 160 inserted into the inside of the upper cover 140 and having an inner surface that is in contact with the extension parts 133 of the nano spreader 130 and an outer surface that is in contact with an inner surface of an exterior housing 143 of the upper cover 140, and a lower lens 170 fixed to a lower part of the lower heat dissipation member 160.

The circle type LED lighting flood lamp 100 according to an embodiment of the present invention further includes sealing members 181, 183, and 185 inserted between the upper cap 150 and the upper cover 140, between the upper cover 140 and the lower heat dissipation member 160, and between the lower heat dissipation member 160 and the lower lens 170, respectively, to improve waterproof performance. O-rings are used as the sealing members.

The nano spreader 130 has a basic structure in the form of a flat plate type member, and the flat plate type member is extended and bent to match the circle type upper cover 140 according to an embodiment of the present invention.

That is, the nano spreader 130 as illustrated in FIG. 2 includes a lower end part 131 that is in partial contact with the LED mounting substrate 120, and a plurality of extension parts 133 branched from the lower end part 131 and extended upward. The nano spreader 130 is in the form of a hook as a whole.

For reference, the nano spreader is a component having excellent heat transfer efficiency, and can promptly transfer the heat generated from a heat source part to another desired place.

That is, the nano spreader has an outer cover formed of a copper plate and a net of a hyperfine structure (nano-sized fine net) installed inside the copper plate, in which pure H2O and steam are separately built on the basis of the hyperfine net. By the heat transferred from a heat source to an outer copper plate that is in partial contact with the heat source, inner pure H2O is converted into stream, and the converted stream dissipates heat to an outside as it moves at high speed, and then is converted into the pure H2O. By repeating the above described process, the nano spreader 130 shows the heat transfer efficiency much better than that of other products.

The technique related to the nano spreader 130 is well known in the art, and thus the detailed description thereof will be omitted.

As illustrated in FIGS. 2 and 3C, the lower end part 131 of the nano spreader 130 is in partial contact with the LED mounting substrate 120 that is a heat source part, and both side surfaces of the extension parts 133 branched from the lower end part 131 are in contact with the heat dissipation portion. For example, with reference to FIG. 3C, the inner surfaces of the extension parts 133 of the nano spreader 130 are in contact with outer surfaces of the inner heat dissipation pins 141 formed inside the upper cover, and the outer surfaces of the extension parts 133 of the nano spreader 130 are in contact with the inner surfaces of the lower heat dissipation member 160.

The extension parts 133 of the nano spreader 130 are extended up to an upper end portion of the upper cover 140 to increase a heat dissipation area.

Accordingly, the nano spreader 130 serves to promptly transfer the heat from the LED mounting substrate 120, which is in contact with the lower end part 131 of the nano spreader 130, through the extension parts 133 of the nano spreader 130, and performs a double heat dissipation through both side surfaces of the respective extension parts 133 of the nano spreader 130.

The cylindrical inner heat dissipation pins 141 are formed on the inside of the upper cover 140, and the exterior housing 143 is formed to be apart from the outer side of the inner heat dissipation pins 141 for a specified distance. As illustrated in FIGS. 4A and 4B, the exterior housing 143 has a recess part formed in the center of an upper part of the exterior housing 143, and outer heat dissipation pins 147 are formed along the circumference of the recess part.

The extension parts 133 of the nano spreader are in contact with the circumference of the inner heat dissipation pins 141 inside the upper cover 140, and heat dissipation plates 163 formed on the circumference of the lower heat dissipation member 160 are in contact with the inner surface of the exterior housing 143.

In this case, by the contact of the exterior housing 143 of the upper cover 140 with the heat dissipation plates 163 of the lower heat dissipation member 160, space formed between the heat dissipation plates 163 forms heat dissipation path R1, and the interior air flowing through the heat dissipation path R1 is discharged to an outside through the space part R2 formed on the circumference of the upper cap 150.

On the other hand, grooves 145 are formed at predetermined intervals on the circumference of a lower end part of the exterior housing 143 of the upper cover 140, and through these grooves 145, outside air flows into the housing. The inflow air passes through the heat dissipation path R1 and the space part R2 of the upper cap, and is discharged to an outside through discharge holes (not illustrated) formed on the upper cap.

In this case, it is preferable that the size of the heat dissipation path R1 is changed as the heat dissipation path goes from the lower part to the upper part. For example, by making the size of the heat dissipation path R1 become smaller as the heat dissipation path R1 goes from the lower part to the upper part of the upper cover, the air flow passing through the heat dissipation path R1 becomes faster as the heat dissipation path R1 goes from the lower part to the upper part.

For reference, in order to change the size of the heat dissipation path R1, it is required to reduce the size of an inner space of the inner heat dissipation pins 141 formed inside the upper cover as the heat dissipation path R1 goes from the upper part to the lower part and to increase the size of an inner space of the exterior housing 143 as the heat dissipation path R1 goes from the upper part to the lower part. In this case, the slope of the outer surface of the inner heat dissipation pins 141 inside the upper cover 140 is opposite to the slope of the inner surface of the exterior housing 143.

The upper cap 150 is fixed to the upper end of the upper cover 140, and the space part R2 (See FIG. 3C) is formed in the upper cap 140 when the upper cap 140 is fixed to the upper end of the upper cover 140. This space part R2 is connected to the heat dissipation path R1, and thus the air flowing in the heat dissipation path R1 passed through the space part R2 and then is discharged to an outside through the discharge holes (not illustrated) formed on the upper cap 150.

The LED mounting substrate 120 is a flat plate type member, and LEDs 110 are attached thereto at predetermined intervals.

As illustrated in FIGS. 2 and 3C, the lower heat dissipation member 160 includes a hollow cylindrical member 161 and a plurality of heat dissipation plates 163 installed at predetermined intervals along the circumference of the cylindrical member 161. The LED mounting substrate 120 and the nano spreader 130 are inserted into the inner space of the cylindrical member 161.

The lower lens 170, which is fixed to the lower part of the lower heat dissipation member 160, is engaged with the lower end of the exterior housing 143 of the upper cover 140, and a specified space of the engagement portion is open by the grooves 145 formed on the lower end of the exterior housing 143 to make the outside air flow through the grooves 145.

In a state where the above described components are assembled together, as illustrated in FIGS. 1 and 3C, the whole external appearance of the LED lighting flood lamp 100 is in the form of a cylinder.

As described above, according to the circle type LED lighting flood lamp using a nano spreader according to the present invention, the nano spreader having high heat diffusion is extended long and is mounted on the inside of the circle type upper cover, so that a prompt heat transfer is performed and the heat dissipation area is increased to maximize the heat dissipation effect.

Since the heat dissipation plates of the heat dissipation member are prevented from exposing to an outside, the efficiency of the heat dissipation plates is prevented from deteriorating due to the sticking of dust and foreign substances thereto even during a long-term use of the lamp.

Also, it is not required to extend the size of the heat dissipation plates even in the case of a high-capacity LED lighting flood lamp, and thus the LED lighting flood lamp can be used for outdoors.

Also, since the circle type LED lighting flood lamp has a simple structure without any fan or other wasting components, the life span of the LED lamp can be prolonged.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A circle type LED lighting flood lamp using a nano spreader, comprising:

LEDs;

an LED mounting substrate on which the LEDs are mounted;

a nano spreader having one side that is in contact with the LED mounting substrate, and the other side that is extended for a specified length to form extension parts;

an upper cover having inner heat dissipation pins that are in contact with the extension parts of the nano spreader;

an upper cap fixed to an upper end of the upper cover;

a lower heat dissipation member inserted into the inside of the upper cover and having an inner surface that is in contact with the extension parts of the nano spreader and an outer surface that is in contact with an inner surface of the upper cover; and a lower lens fixed to a lower part of the lower heat dissipation member.

2. The circle type LED lighting flood lamp of claim 1, further comprising sealing members inserted between the upper cap and the upper cover, between the upper cover and the lower heat dissipation member, and between the lower heat dissipation member and the lower lens, respectively.

3. The circle type LED lighting flood lamp of claim 1, wherein the nano spreader is composed of a lower end part that is in partial contact with the LED mounting substrate, and extension parts branched from the lower end part and extended upward.

4. The circle type LED lighting flood lamp of claim 3, wherein the upper ends of the extension parts of the nano spreader are extended up to an upper portion of the upper cover to increase an area of the heat dissipation part.

5. The circle type LED lighting flood lamp of claim 1, wherein the upper cover comprises cylindrical inner heat dissipation pins formed therein and an exterior housing formed apart from an outer side of the inner heat dissipation pins for a specified distance.

6. The circle type LED lighting flood lamp of claim 5, wherein grooves are formed at predetermined intervals on a lower end part of the exterior housing of the upper cover to make an inflow of outside air.

7. The circle type LED lighting flood lamp of claim 5, wherein the exterior housing of the upper cover has a recess part formed in the center of an upper part of the exterior housing, and outer heat dissipation pins are formed along the circumference of the recess part.

8. The circle type LED lighting flood lamp of claim 1, wherein the lower heat dissipation member comprises a hollow cylindrical member, and a plurality of heat dissipation plates installed at predetermined intervals along the circumference of the cylindrical member;

wherein when the upper cover is fixedly put on the heat dissipation plates, a heat dissipation path is formed between the upper cover and the heat dissipation plates.

9. The circle type LED lighting flood lamp of claim 8, wherein the size of the heat dissipation path becomes smaller as the heat dissipation path goes from the lower part to the upper part of the upper cover.

* * * * *